United States Patent [19]

Mista et al.

[11] 4,448,046

[45] May 15, 1984

[54] ELECTROMAGNETICALLY ACTUATED JACQUARD CONTROL ARRANGEMENT

[75] Inventors: Kresimir Mista, Obertshausen; Hans-Jurgen Hohne, Hainburg, both of Fed. Rep. of Germany

[73] Assignee: Karl Mayer Textilmaschinenfabrik GmbH, Obertshausen, Fed. Rep. of Germany

[21] Appl. No.: 445,950

[22] Filed: Dec. 1, 1982

[30] Foreign Application Priority Data

Dec. 4, 1981 [DE] Fed. Rep. of Germany ..... 3148054

[51] Int. Cl.[3] ..... D04B 23/04

[52] U.S. Cl. ..... 66/205; 66/207

[58] Field of Search ..... 66/205, 203, 204, 207, 66/214

[56] References Cited

U.S. PATENT DOCUMENTS 4,141,230 2/1979 Kohl ..... 66/204

4,285,217 8/1981 Mista et al. ..... 66/205

*Primary Examiner*—Ronald Feldbaum

*Attorney, Agent, or Firm*—Omri M. Behr

[57] ABSTRACT

In an electromagnetically operated, jacquard control arrangement, each controllable element is provided with an electromagnet cooperating with an anchor. An actuating current switch can energize the electromagnet arrangement. A swingably mounted control element provides a movable contact point on a lever arm for moving controllable elements. A swingable synchronization arrangement is driven back and forth by a continually rotating main shaft which can also turn the control element in one direction over a predetermined working angle. A return spring, in dependence upon the activation condition of the electromagnet, can swing back the control element. At the beginning of each working cycle the anchor is positioned proximate the poles of the electromagnet. The anchor is attached to the control element. The anchor of the control element may be carried by the synchronization arrangement. The switching arrangement is provided with a timing device which maintains the activation of the electromagnet commencing at the beginning of a work cycle over the major portion of the work cycle.

13 Claims, 4 Drawing Figures

ELECTROMAGNETICALLY ACTUATED JACQUARD CONTROL ARRANGEMENT

BACKGROUND OF THE INVENTION

1. Field of the Invention

The invention is directed to an electromagnetically operated jacquard control arrangement wherein each controllable element is provided with an electromagnet cooperating with an anchor and actuated by a current switching arrangement. A rotatably mounted final control element provides a movable connecting point on a lever arm attached to a controllable element. A synchronization arrangement is reciprocated by a continually rotatable main shaft and is, suitably, mounted on the same axis as the final control element. This synchronization element can carry the control element in one direction over a predetermined working angle against a setting spring which, in dependence upon the activated condition of the electromagnet, can return the final control element into its original position. However, the anchor rests against the poles of the electromagnet at the beginning of each working cycle.

2. Discussion of the Relevant Art

In a known control arrangement of this type (U.S. Pat. No. 4,285,217) the anchor of the electromagnet must interact with a striking surface of the control element every time that the control element must be stopped. This requires high structural tolerances in both the anchor and the striking surface. Furthermore, abrasions are unavoidable and the biasing spring on the anchor can become relaxed. Also, the synchronization arrangement must cause the final control element to run past the stop position by a small amount in order to free the anchor. Thus, there are additional abrasions and noises occurring between the final control element and the synchronization arrangement. The electromagnets are activated at the beginning of the working cycle only until the striking surface has moved past the held anchor.

Thus, there is a need for a jacquard arrangement of the above described type which is structurally more efficient, economical, subject to a lower degree of abrasion and which develops less noise.

SUMMARY OF THE INVENTION

An electromagnetically controlled jacquard arrangement according to the principles of the present invention operates in a machine having working cycles controlled by a main shaft. The jacquard arrangement has a plurality of electromagnetic devices and a plurality of control elements. The control elements are rotatably mounted to reciprocate in the machine and are biased to rotate in a first direction. The electromagnetic devices can each operate to hold magnetically a corresponding one of the control elements in a predetermined position. Also included is a synchronization means coupled to and reciprocated by the main shaft for repetitively urging the control elements to rotate in a second direction and place them proximate to the electromagnetic device at the start of each of the working cycles. The jacquard arrangement also has a switching means that can operate over successive working cycles to energize sequentially preset ones of the electromagnetic devices according to a predetermined pattern. The switching means includes a timing means for maintaining energization in existence at the beginning of each of the working cycles and throughout a major portion of each of the working cycles.

By utilizing apparatus of the foregoing type an improved jacquard arrangement is obtained. Preferably a magnetically attractable anchor is attached to the final control elements while a synchronization arrangement can carry the final control elements until the anchor contacts the poles of an electromagnet. Also a timing means is provided to activate a current switching arrangement for holding the initial activated state of the electromagnets, at least over a substantial portion of the working cycle. In a particularly simple arrangement the timing means comprises a storage member which takes up a pattern signal from a program and delivers it as a switching signal for the activation of the magnetizing current switching arrangement.

With respect to the construction, it is desirable that the final control element has radial coupling arms with which the synchronization element will interact. In contrast to an axially protruding, coupling striker, this arrangement permits a tighter arrangement of the control elements. A particularly simple arrangement arises when a common synchronization arrangement is provided for all of the control elements in the form of a contact bar mounted parallel to the axis of rotation for interaction with the coupling arms. This brings about a further saving in construction costs, which in turn leads to savings in expenditures and an increase in reliability and efficiency.

BRIEF DESCRIPTION OF THE DRAWINGS

In order that the invention may be more fully understood, it will now be described, by way of example, with references to the accompanying drawings in which.

DESCRIPTION OF THE PREFERRED EMBODIMENT

Figure 1:
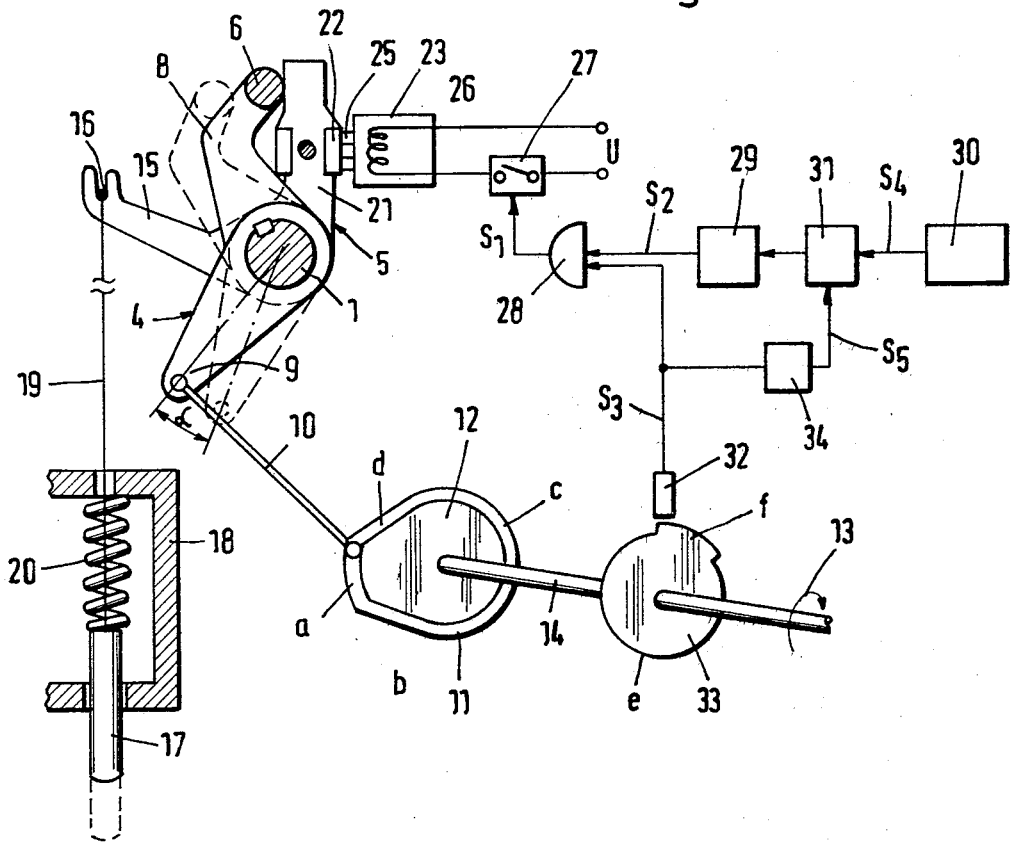
FIG. 1 is a schematic representation of a jacquard control arrangement according to the principles of the present invention showing the anchor in the magnetically held position.
Figure 2:
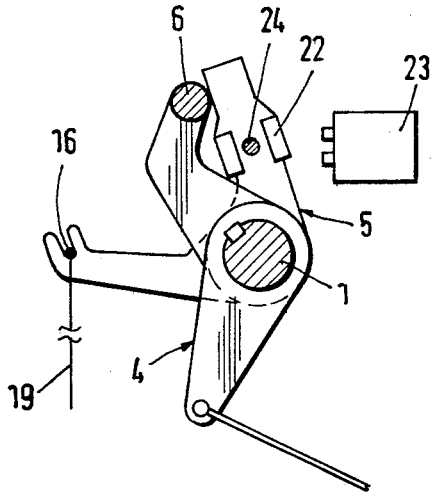
FIG. 2 is a partial representation of FIG. 1 showing the anchor in the released position.
Figure 3:
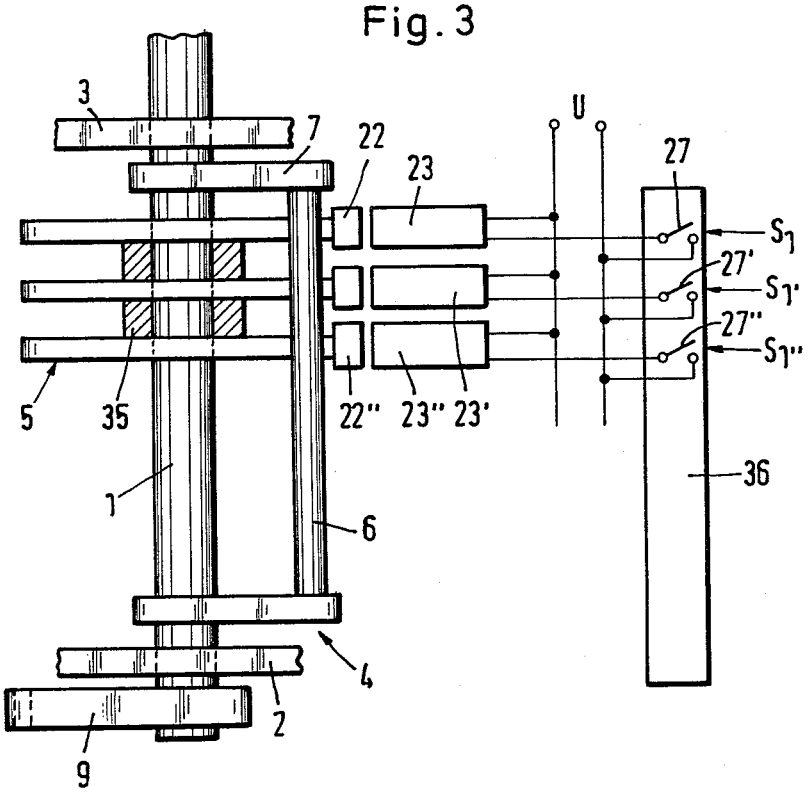
FIG. 3 is a plan view of the control arrangement of FIG. 1.

Referring to FIGS. 1, 2 and 3, an electromagnetically controlled jacquard arrangement has a common shaft 1 whose ends are journalled in housing walls 2 and 3 (FIG. 3). A synchronization means 4 is non-rotatably mounted to shaft 1, final control elements 5 being rotatably mounted on the shaft. Synchronization arrangement 4 comprises a contact rod 6 mounted parallel to the axis of shaft 1 to act as a coupling element. The ends of rod 6 are perpendicularly connected to said shaft 1 via lever arms 7 and 8 (FIGS. 1 and 3). Arms 7 and 8 are affixed by keying or otherwise to shaft 1 on opposite sides of control elements 5. Arms 7 and 8 are plate-like levers each having a dog-leg to the right, as viewed in FIG. 1. On the outside of wall 2, keyed to the end of shaft 1 is lever arm 9 formed from a plate having a tear-shaped plan (i.e. tapered with a rounded free end). Its outer free end is pivotably connected to one end of push rod 10 whose other end runs in a cam track 11 on cam plate 12 which is connected to main shaft 14, both continually rotating in the direction of arrow 13. Cam track 11 comprises a constant displacement sector a, a falling transition sector b, a longer constant displacement sector c and a final rising transition sector d. As a consequence the synchronization arrangement 4 is angularly reciprocated between the positions shown in full line and phantom through angle $\alpha$. Lever 9 and shaft 1 rock through angle $\alpha$ in synchronism with the rotation of main shaft 14. Each of the control members 5 comprises lever arm 15 rotatably mounted on and extending radially from shaft 1. The outer end of lever 15 terminates in a pair of generally transverse fingers forming a contact location 16 for operating controlled element 17. The element 17 moves from the full-line position to that indicated by the phantom lines when lever 15 of control element 5 moves into the position indicated in FIG. 2. In the illustrated embodiment, element 17 is shown as a dropper peg, one of many parallel pegs, used to affect the operation of a thread guide (not shown) in a conventional manner. One such arrangement is described in U.S. Pat. No. 4,285,217. Dropper peg 17 is slidably held in an aperture in the lower shelf of a double-shelf peg bar 18. The upper end of peg 17 is connected to contact location 16 via a harness cord 19. The controllable element 17 is biased downwardly by compression spring 20 which at the same time operates as a return spring for control element 5. Helical spring 20 spans the upper end of peg 17 and the inside surface of the upper shelf of peg bar 18, encircling harness cord 19. Cord 19 emerges through an aperture atop bar 18. Bar 18 runs parallel to the thread guide bar (not shown) and carries a plurality of pegs, springs and cords; the pegs comprising an independent set of controlled members for influencing the manner in which thread is layed. As described further hereinafter a corresponding control element, such as element 5, is provided for each peg 17.

Extending at an acute angle with respect to lever 15 on control element 5 is a substantially radially extending coupling arm 21 on which magnetically permeable anchor 22 of electromagnet 23 is attached with a certain measure of play. For this purpose, the anchor has a C-shaped cross-section allowing it to embrace loosely, coupling arm 21. A plug 24 perpendicularly and centrally affixed to arm 21 is loosely journalled through a central aperture in anchor 22, plug 24 terminating in a head beyond anchor 22 to loosely secure it. Anchor 22 is positioned substantially half-way between the axis of rotation 1 of control member 5 and the contact point of arm 21 with synchronization bar 6.

In this respect it is desirable to attach anchor 22 on coupling arm 21 between the swinging axis of shaft 1 and the contact point of synchronization element 6 so that a mechanical advantage is obtained. Therefore resetting springs 20 may be comparatively weak and still will be able to pull anchor 22 back against the residual forces, after cessation of the activation of electromagnet 23. This also leads to a more compact construction form. It is advantageous to permit anchor 22 some mechanical play at its mounting on final control element 5. In particular, one is concerned about the turning and sliding play. This play provides anchor 22 with a certain mobility relative to final control member 5 wherein construction tolerances can be compensated out.

Electromagnet 23 has a coil 26 magnetically coupled to poles 25 whose outer ends may be considered a pair of potential terminals of a magnetic circuit. Accordingly, magnetically permeable members, such as anchor 22, brought next to poles 25 can be held thereby. In the full-line position of synchronization arrangement 4, (FIG. 1) synchronization bar 6 brings anchor 22 substantially in front of poles 25 of the electromagnet. If coil 26 carries sufficient magnetizing current, anchor 22, and thus control element 5, will be held in the illustrated position during a working cycle even if synchronization arrangement 4 moves back into the position illustrated in phantom in FIG. 1. If there is no activating current, the force of the return spring 20 will cause control element 5 to remain in contact with synchronization bar 6 and move with it into the position illustrated in FIG. 2.

Since in the foregoing construction anchor 22 is unified with final control element 5, fewer parts are needed. Furthermore, no extraordinary finishing tolerance between anchor 22 and control element 5 need be considered. Both features lead to a structural economy of the arrangement. Since cooperative action between anchor 22 and a striking surface is no longer required, this segment can no longer be the subject of abrasion or responsible for generation of noise. Furthermore, the abrasion on the coupling point between synchronization rod 6 and control arm 21 as well as the noise produced due to impact therebetween is substantially reduced since elements for setting control element 5 only come in contact with the control element preferably when it is held fast by the anchor at the reversal point of its movement. The unity of construction of anchor 22 and final control element 5 is possible because the control element is not held fast mechanically by the anchor but rather electrically in consequence of the relatively long activation time of electromagnet 23, provided in a manner described hereinafter.

A current source is applied to terminals U which have serially connected between them coil 26 and the switching contacts of control switch 27. Switch 27 can be a relay, semiconductor switch or other device which closes in response to a high signal being applied to its input line S1. By means of activation current switch 27, electromagnet 23 can be brought into circuit with current source U. Switching arrangement 27 is preferably electronically equipped and is displaced into the operative position by means of activating signal S1. Signal S1 is taken from the output of AND gate 28 whose inputs comprise a switching signal S2 and, at another input, cycle signal S3. The switching signal S2 is provided at the output of a holding means 29 which may be a latch or other storage device for holding pattern signals. Storage device 29 may have a plurality of output lines (one such line illustrated herein) cooperating with a plurality of AND gates, such as gate 28. It will be appreciated that these gates control a plurality of electromagnetic devices such as: switch 27, electromagnet 23 and anchor 22. The pattern signals stored by device 29 are derived from control signal S4 from program device 30 via a storage loading arrangement 31 when the latter receives the corresponding loading signal S5. Program device 30 may be a memory device already provided with the pattern to be produced by the jacquard arrangement. Loading arrangement 31 can be an appropriate processor for sequentially addressing device 30 and loading its data into storage device 29 sequentially. For the formation of the cycle signal S3, there is provided a proximity sensor 32 which may be magnetically influenced by a projection on trigger disc 33 affixed to and rotating with main shaft 14. Cycle signal S3 is generated over the major circumferential portion e and is suppressed during the smaller circumferential portion f.

In the switching member 34, the falling edge (FIG. 4) of cycle signal S3 provides a loading signal in the form of a relatively short pulse, after a small delay. In one embodiment switching member 34 can be a delay circuit capacitively coupled to a one-shot multivibrator, although other circuit arrangements are possible.

Referring to FIG. 3, it illustrates that the setting members 5 comprise a plurality of parallel, coaxial discs which are separated from each other by annular separators 35. There is further shown in a row, a plurality of electromagnets 23, 23' and 23'' to each of which is provided a switching means 36 comprising a group of switching arrangements 27, 27' and 27''. The individual switching arrangements are actuated by signals S1, S1', and S1''. Switched contacts of switches 27, 27' and 27'' are serially connected with electromagnets 23, 23' and 23'', respectively, across potential U. It will be understood that in practical embodiments the apparatus of FIG. 3 will have more than three control elements 5.

In operation, main shaft 14 (FIG. 1) rotates once for each working cycle. Such a working cycle may be considered through the time diagram of FIG. 4, in which the modes of operation will be perceived presently. The diagram comprises an entire working cycle wherein the starting point is shown at time point $t_o$. Prior to time $t_o$ during the active portion of the previous cycle, push rod 10 travels constant-displacement track c so that arm 8 and rod 6 are in the positions illustrated in phantom in FIG. 1 at which position they have no effect on whether control element 5 approaches near or reaches electromagnet 23. In this prior cycle, before time $t_1$, control element 5 may be positioned as shown either in FIG. 1 or FIG. 2.

In this preferred embodiment, cycle signal generator 32, which generates cycle signal $S_3$ from the beginning of the previous work cycle, provides shortly before its end at time $t_1$, a low signal. This low signal is applied to one input of AND gate 28 causing it to produce a low signal for at least the length of interruption 37. Thus signal $S_3$ insures that independently of the working speed of the control arrangement, switch 27 is open so that although electromagnet 23 can, if desired, be activated for a sufficiently long time, almost to the end of the working cycle, nevertheless an interruption of the magnetizing current does occur so that at the commencement of a new working cycle a new decision may be made to retain or free anchor 22. In the event that at time $t_1$ anchor 22 was not yet released from electromagnet 23, the interruption of current positively releases anchor 22. Accordingly, spring 20 drives cord 19 and lever arm 15 downwardly, resulting in the released condition of FIG. 2.

Figure 4:
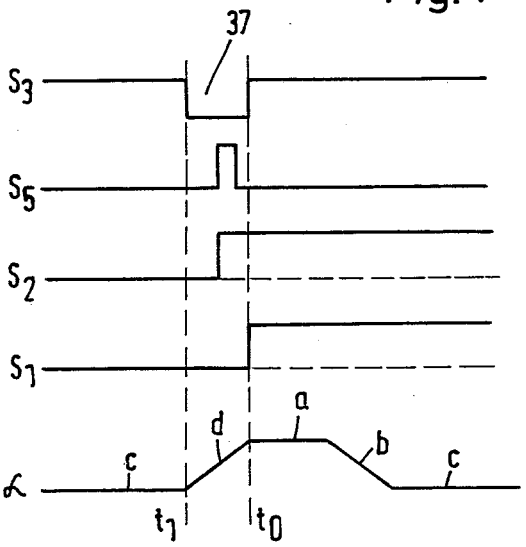
FIG. 4 is a timing diagram of the signals associated with the apparatus of FIG. 1.

Next, sector d of cam plate 12 commences so that angle $\alpha$ increases as shown during interruption interval 37 of FIG. 4. The cycle signal S3 generated by the generator 32 terminates shortly before the end of the prior work cycle at time point $t_1$, recommencing at time $t_o$. In the thus formed cycle signal pause 37, the falling edge of cycle signal S3 triggers switching member 34 to produce eventually, loading signal S5. In consequence thereof, processor 31 calls from program means 30 the latest control signals S4 and delivers them to storage member 29 which holds these value to generate switching signal S2. Where this has a value 1 the actuating signal S1 is generated with value 1 prior to time point $t_o$. On the other hand, if the switching signal S2 has the value 0 as is shown in phantom in FIG. 4, the actuating signal S1 has value 0.

The control signals of the program indicate the desired patterning. The storage time of the storage element 29 may be chosen as desired so that the activation of the electromagnets 23 is maintained for a sufficient amount of time.

It is advantageous to use storage charging arrangements in which a new control signal is provided to the storage member 24 during the cycle signal breaks 37. This means that the activating signal depends upon the end of the cycle signal of the old switching signal and the beginning of the new cycle signal of the new switching signal. Thus it is possible to readily reload the storage element 29. It is particularly advantageous to employ the falling edge of the cycle signal $S_3$, if desired, under the interposition of the timing means, for the control of the storage charging arrangement. A linking switch 28 in the presence of a switching signal $S_2$ during the presence of the cycle signal $S_3$ gives an activating signal $S_1$ to the activating current switching arrangement 27. In particular, the linkage switch is an AND gate into whose inputs the switching signal $S_2$ and the cycle signal $S_3$ are led and from whose output the activation signal $S_1$ is given.

It is particularly advantageous to cause synchronization arrangement 4 to be driven by cam plate 12 (which comprises a constant path section a between an increasing d and a decreasing b path section) so that anchor 22 is brought against pole 25 of electromagnet 23 by the beginning $t_o$ of the new work cycle and is held there for a predetermined waiting period. If electromagnet 23 is activated during this time, then control element 5 is held fast. On the other hand, if the electromagnet is not activated then the control element is eventually freed.

The displacements of segment a through d of cam track 11 determines the swing angle of the synchronization arrangement 4. The path segments have a defined position with respect to cycle signal $S_3$ since cam 12 and trigger disc 33 are both mounted on the same shaft 14. During the constant path segment a, the entire arrangement takes up the position shown in the fully aligned position shown in FIG. 1. Where the actuating signal $S_1$ has a value of 1 at the beginning of the working cycle, anchor 22 is held fast to electromagnet 23 even when the synchronization arrangement is in the phantom position of FIG. 1. On the other hand, if, at this point in time, electromagnet 23 is not activated, control element 5 will move with the synchronization arrangement into the position shown in FIG. 2. In a practical embodiment it has been proposed that the constant path portion a may have a length of 40°, the constant path segment c, a length of 190° and the rising and lowering segments b and d, a length of 65°.

Thereafter, descending segment b occurs followed by constant segment c which has a greater length than the first constant path segment a between the increasing and decreasing path segments. This constant path segment c defines the other end position of element 4 during the major portion of the work cycle.

The actuating signal can also be generated in other ways from a control signal from the program means 30. It is only important that if at the beginning of the work cycle the electromagnet 23 is instructed into the activated situation, that the actuating signal insures that this activated condition is also maintained during the major portion of the working cycle.

The above described jacquard arrangement is particularly suitable for use with warp knitting machines in which the individual control elements 5 are located above their appropriate controlled elements 17. It will also be noted that the mutual displacement of the time diagram of FIG. 4 is not harmful as long as the path segment a overlaps with the beginning of the activating signal $S_1$. It is also possible for the pause 37 to be smaller or the switching signal pass directly to the switching arrangement 27. It is particularly desirable to provide the program means in the form of a computer.

It will be understood that various changes in the details, materials, arrangement of parts and operating conditions which have been herein described and illustrated in order to explain the nature of the invention may be made by those skilled in the art within the principles and scope of instant invention.

What is claimed is:

1. An electromagnetically controlled jacquard arrangement for a machine having working cycles controlled by a main shaft, comprising:

a plurality of control elements rotatably mounted to reciprocate in said machine and biased to rotate in a first direction;

a plurality of electromagnetic devices, each operable to hold magnetically a corresponding one of said control elements in a predetermined position;

synchronization means coupled to and reciprocated by said main shaft for repetitively urging said control elements to rotate in a second direction and lace them proximate to said electromagnetic device at the start of each of the working cycles; and switching means operable over successive working cycles to energize sequentially, given ones of said electromagnetic devices according to a predetermined pattern, said switching means including timing means for maintaining energization in existence at the beginning of each of the working cycles and throughout a major portion of each of the working cycles.

2. A jacquard arrangement according to claim 1 further comprising:

a plurality of controlled members each mounted in said machine for reciprocating therein, each of said control elements having a magnetically permeable anchor and a lever arm terminating at a free end, said free end connecting to a corresponding one of said controlled members for moving it, said synchronization means being rotatably mounted coaxially with said control elements and being operable to press said anchor in each of said control elements against a corresponding one of said electromagnetic devices.

3. A jacquard arrangement according to claim 2 wherein said timing means comprises:

program means for storing and recalling pattern signals corresponding to said predetermined pattern; and holding means for receiving and holding said pattern signals and for operating said switching means in response to held ones of said pattern signals.

4. A jacquard arrangement according to claim 3 wherein said switching means comprises:

a signal generator coupled to said main shaft for providing a cycle signal having a given state during a majority of each of the working cycles commending at the start and concluding before the end of each of the working cycles; and a gating device coupled to said signal generator and said holding means for producing a switching signal in response to the pattern signals from said holding means during the term of said given state.

5. A jacquard arrangement according to claim 4 wherein said gating device comprises:

an AND gate having an input line coupled to said signal generator and an output line carrying said switching signal.

6. A jacquard arrangement according to claim 5 wherein said switching means further comprises:

a loading arrangement for transferring to said holding means from said programming means updated ones of said pattern signals prior to the start of each of said working cycles.

7. A jacquard arrangement according to claim 6 wherein said loading arrangement is operated in response to the trailing edge of said given state of said cycle signal to update said pattern signals.

8. A jacquard arrangement according to claim 1 wherein said anchor comprises a separate member coupled to its corresponding one of the control elements with a predetermined amount of mechanical play.

9. A jacquard arrangement according to claim 8 wherein each of said control elements has a substantially radially projecting arm sized to engage and be driven by said synchronization means.

10. A jacquard arrangement according to claim 9 wherein said anchor is mounted on said radially projecting arm, said synchronization means being operable to engage said radially projection arm at a position more radially remote than said anchor.

11. A jacquard arrangement according to claim 10 wherein said synchronization means comprises:

a rod mounted parallel and movable with respect to the axis of rotation of said control elements, said rod being movable to commonly engage the radially projecting arm of each of said control elements.

12. A jacquard arrangement according to claim 11 wherein said synchronization means comprises:

a cam driven at a rate proportional to the rate of rotation of said main shaft, said cam having at least three sectors comprising a constant displacement sector preceded and followed by a first and second transition sector, respectively, said cam being coupled to said rod to simultaneously drive the anchor of each of said control elements into close magnetic coupling with said electromagnetic devices at the beginning of each of the working cycles and for a predetermined interval thereafter.

13. A jacquard arrangement according to claim 12 wherein said cam has a fourth sector following said second transition sector and preceding said first transition sector, said fourth sector being sized to produce for a greater amount of time than said constant displacement sector a displacement differing from that of said constant displacement sector.

* * * * *